US007093954B2

(12) United States Patent
Sharrah et al.

(10) Patent No.: US 7,093,954 B2
(45) Date of Patent: Aug. 22, 2006

(54) FLASHLIGHT HAVING LED ASSEMBLY AND METHOD FOR PRODUCING SAME

(75) Inventors: Raymond L. Sharrah, Collegeville, PA (US); John DiNenna, Bridgeport, PA (US)

(73) Assignee: Streamlight, Inc., Eagleville, PA (US)

( * ) Notice: Subject to any disclaimer, the term of this patent is extended or adjusted under 35 U.S.C. 154(b) by 0 days.

(21) Appl. No.: 11/015,731

(22) Filed: Dec. 17, 2004

(65) Prior Publication Data

US 2005/0135090 A1 Jun. 23, 2005

Related U.S. Application Data

(60) Provisional application No. 60/627,860, filed on Nov. 15, 2004, provisional application No. 60/531,174, filed on Dec. 19, 2003.

(51) Int. Cl.
*F21L 4/00* (2006.01)
*F21V 29/00* (2006.01)

(52) U.S. Cl. ..... 362/202; 362/294; 362/800

(58) Field of Classification Search ..... 362/183, 362/184, 202, 204, 205, 20, 208, 197, 294, 362/800, 157

See application file for complete search history.

(56) References Cited

U.S. PATENT DOCUMENTS

| | | | | |
|---|---|---|---|---|
| 6,502,952 | B1 * | 1/2003 | Hartley | 362/184 |
| 6,595,656 | B1 * | 7/2003 | Yoda | 362/187 |
| 6,827,468 | B1 * | 12/2004 | Galli | 362/294 |
| 2003/0147237 | A1 * | 8/2003 | Halasz | 362/187 |
| 2004/0240201 | A1 * | 12/2004 | Rausseck | 362/171 |

* cited by examiner

*Primary Examiner*—Alan Cariaso
*Assistant Examiner*—James W Cranson, Jr.
(74) *Attorney, Agent, or Firm*—Stephen H. Eland; Dann, Dorfman, Herrell and Skillman

(57) ABSTRACT

A flashlight is provided having a housing, a reflector and a light source, such as an LED. Preferably, an alignment structure is provided for aligning the LED with the focal axis of the reflector. For instance, the LED may be fixed to a circuit board, and the flashlight may include an alignment element configured to mate with the LED to position the LED at a pre-determined position. Alternatively, the LED may be electrically connected with a circuit board, and the circuit board my include an opening for receiving the LED to position the LED at a pre-determined position.

35 Claims, 6 Drawing Sheets

FLASHLIGHT HAVING LED ASSEMBLY AND METHOD FOR PRODUCING SAME

RELATED APPLICATIONS

This application claims priority to U.S. Provisional Patent Application No. 60/531,174, which was filed on Dec. 19, 2003 and which is hereby incorporated herein by reference. This application also claims priority to U.S. Provisional Patent Application No. 60/627,860, which was filed on Nov. 15, 2004.

FIELD OF THE INVENTION

The present invention relates to flashlights having LED assemblies. More specifically, the present invention relates to an LED flashlight having an LED positioned at a focal point of a reflector. The present invention also relates to a method for producing an LED flashlight with the LED positioned at a focal point of the reflector.

BACKGROUND OF THE INVENTION

Flashlights having an LED positioned within a reflector for providing a focused beam of light are known in the art. In order to optimize the beam of light provided by the LED, it is desirable to position the LED at the focal point of the reflector. Specifically, a reflector typically has a parabolic reflective surface having a central axis. It is desirable to position the LED so that it is aligned with the central axis of the reflective surface.

Unfortunately, due to manufacturing tolerances in the production of LEDs, the location of an LED in an assembly can vary. This leads to variation of the LED position relative to the reflector, which can reduce the ability to provide an optimum focused beam of light.

SUMMARY OF THE INVENTION

In light of the foregoing shortcomings of the prior art, the present invention provides a flashlight having an LED assembly that is centered within a reflector to provide an optimally focused beam of light. Specifically, the present invention includes a housing, a reflector and a lamp assembly. The lamp assembly comprises an LED element and one or more aligning elements configured to cooperate with a portion of the LED and a surface of the housing. In this way, the aligning element positions the LED at a consistent position, thereby positioning the LED at a predetermined position relative to the reflector.

The present invention also provides a method for producing a flashlight, comprising the steps of assembling a lamp assembly, positioning the lamp assembly at a predetermined position relative to the body, and positioning the reflector at a predetermined position relative to the lamp assembly, so that the reflector is positioned at a predetermined position relative to the LED. The lamp assembly is assembled by positioning an LED hub within a locating element to position the LED relative to the locating element. Additionally, the locating element may then be positioned within a housing to position the locating element at a predetermined position relative to the housing.

BRIEF DESCRIPTION OF THE DRAWINGS

The foregoing summary and the following detailed description of the preferred embodiments of the present invention will be best understood when read in conjunction with the appended drawings, in which.

DETAILED DESCRIPTION OF THE PREFERRED EMBODIMENT

Figure 1:
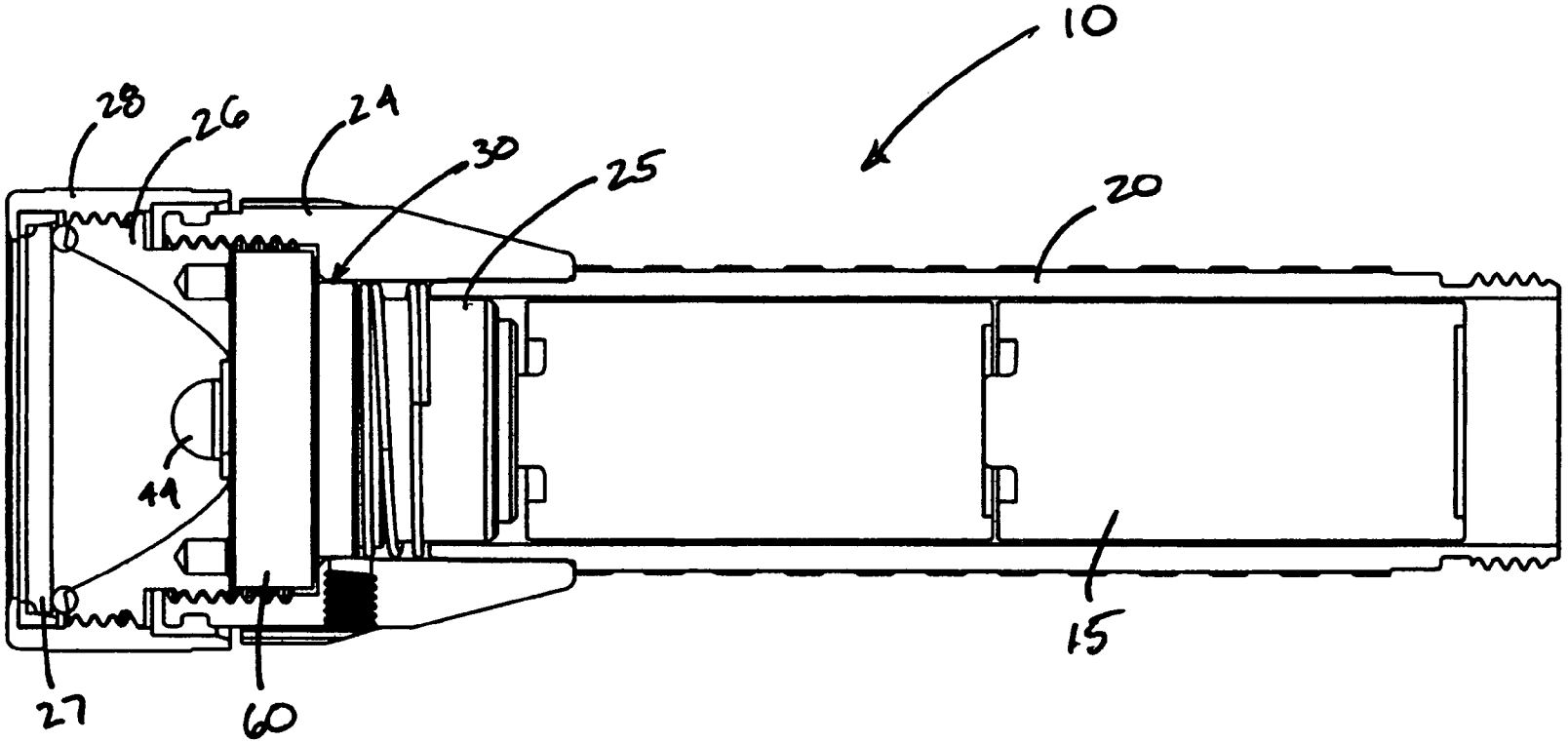
FIG. 1 is a cross-sectional view of a flashlight.

Referring now to the figures in general, wherein like elements are numbered alike throughout, a flashlight is designated generally 10. The flashlight 10 comprises a housing 20, a lamp assembly 30 disposed within the housing, and a reflector 26 for focusing the light provided by the lamp assembly. An face cap 28 encloses the reflector 26 and the lamp assembly 30 within the housing 20.

Turning to FIG. 1, the elements of the flashlight will be described in greater detail. The housing 20 may be configured in a variety of shapes and sizes depending upon the application for the flashlight. FIG. 1 illustrates an exemplary shape that is generally cylindrical having a hollow interior forming a battery chamber configured to receive a plurality of batteries 15. The rearward end of the housing may be open so that the batteries can be replaced without having to remove the lamp assembly 30. In such an instance, an end cap (not shown) is attached to the housing to enclose the batteries within the housing. Alternatively the rearward end of the housing can be a closed end so that the batteries are replaced by removing the lamp assembly.

A flashlight head 24 is preferably fixedly attached to the forward end of the housing 20. The flashlight head 24 has a central bore that is sized to received the lamp assembly 30 as discussed further below. Preferably, the flashlight head 24 has a connector for connecting the reflector 26 to the flashlight head. For instance, as shown in FIG. 1, the flashlight head 24 may include a threaded portion that cooperates with threads on the reflector 26 to threadedly connect the reflector with the flashlight head. In this way, the threaded connection between the flashlight head and the reflector operates to position the reflector relative to the flashlight head. Although a threaded connection is illustrated, a variety of connections can be used to connect the reflector with the flashlight head. For instance, the flashlight head may include one or more tabs that project radially inwardly that cooperate with recesses in the reflector to locate the reflector relative to the flashlight head.

The reflector 26 includes a reflective surface operable to reflect and focus the beam of light produced by the lamp assembly 30. The reflector has an aperture through which the lamp element projects so that the lamp element projects into a space within the reflective surface of the reflector. Preferably, the reflective surface is a parabolic shaped surface disposed about a focal axis of the reflector and the lamp element is aligned with the focal axis. The focal axis is a line extending through the focal point of the reflective surface.

As shown in FIG. 1, preferably a lens 27 is disposed over the reflector 26. More specifically, a face cap 28 mounted over the lens 27 holds the lens against the reflector. The face cap 28 is connected with the reflector, such as by mating threads. Alternatively, the face cap may threadedly engage the flashlight head 24. Additionally, the flashlight may include a seal between the lens and the reflector to provide a fluid-tight seal to prevent fluid from leaking into the interior of the flashlight. In addition, the threaded connection between the reflector and the flashlight head or alternatively between the face cap and the collar may be configured to allow the reflector to move relative to the lamp assembly 30, so that the reflective surface can be displaced relative to the lamp element along the focal axis.

Figure 2:
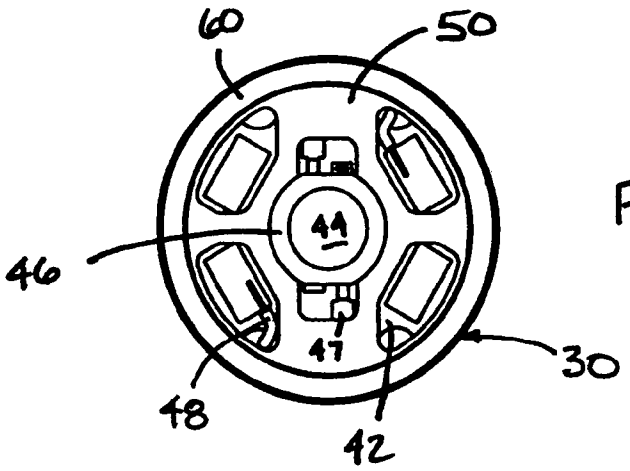
FIG. 2 is a top view of a lamp assembly of a flashlight shown in FIG. 1.
Figure 3:
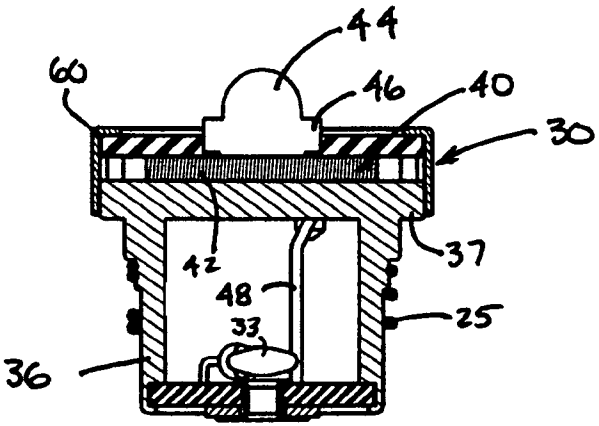
FIG. 3 is a cross-sectional view of the lamp assembly of FIG. 2, taken along the line 3—3
Figure 4:
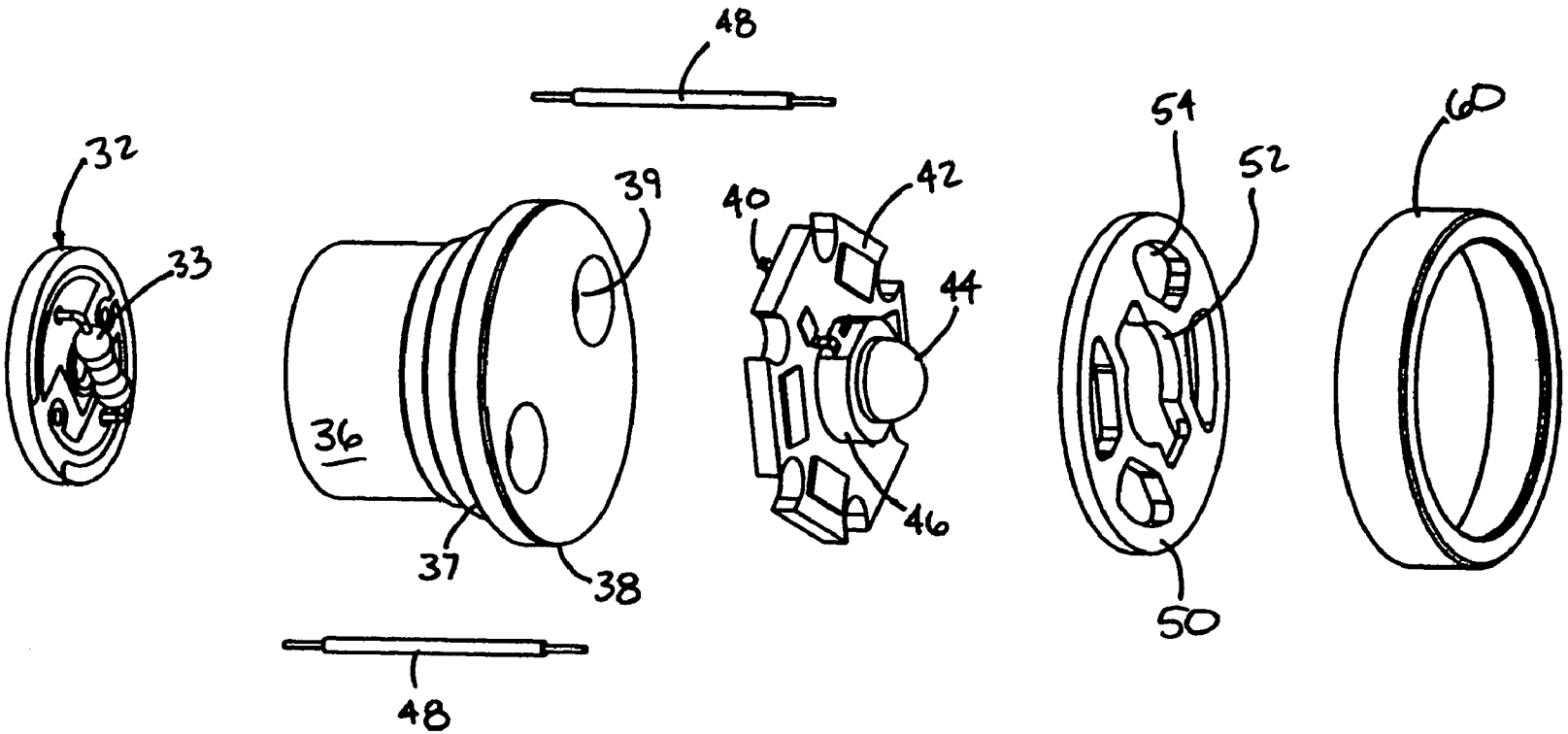
FIG. 4 is an exploded perspective view of a lamp assembly shown in FIG. 2.
Figure 5:
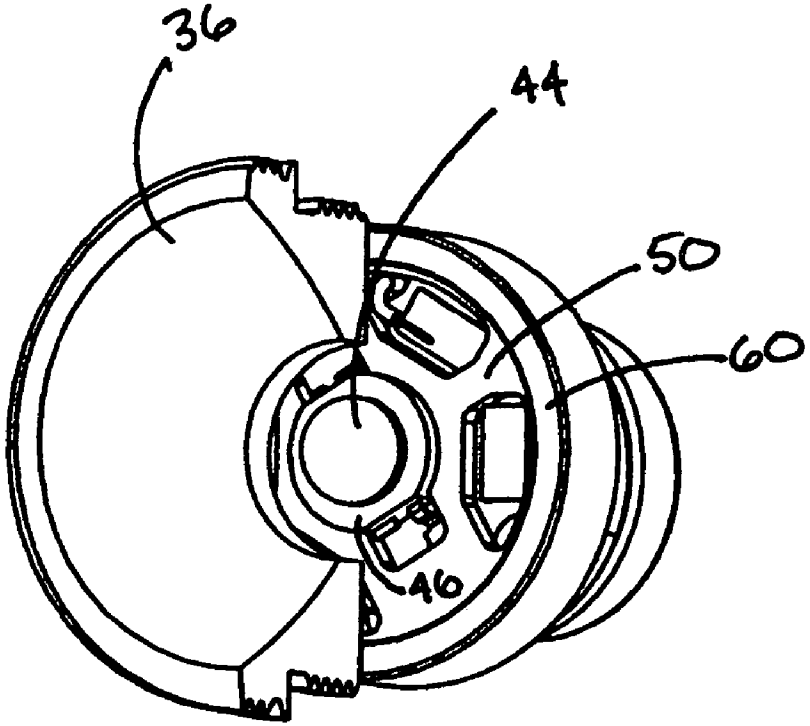
FIG. 5 is a perspective view, partially broken away, of the flashlight shown in FIG. 1.

Turning now to FIGS. 2–4, the details of the lamp assembly 30 will be described in detail. The lamp assembly 30 comprises an LED assembly 40, a spacer 50 and a housing. The housing is formed by a cap 60 and a block 36 that preferably also operates as a heat sink, as described further below.

The LED assembly 40 comprises an LED 44 having a generally disk-shaped hub 46. In this way, the hub 46 is configured like a collar projecting radially outwardly from the dome of the LED 44. As shown in FIG. 2, the hub 46 may have one or more flat edges, so that the hub is not completely circular.

The LED 44 is preferably mounted on a circuit board 42. In addition, preferably a thermally conductive material is attached to the circuit board to operate as a heat sink. For instance, a layer of aluminum may be bonded to the circuit board.

Contacts 47 for the LED 44 project away from the hub 46 of the LED, as shown in FIG. 2. The contacts 47 are electrically connected to the circuit board, such as by soldering the contacts to the board. In addition, preferably wires 48 are soldered to the circuit board 42 to provide an electrical path between the LED assembly 40 and a PC board assembly 32 described further below.

Due to manufacturing tolerances, the position of the LED 44 on the circuit board 42 may vary. Accordingly, a spacer 50 is provided for aligning the LED 44. The spacer is a disc-spaced element, preferably formed of insulating material. The spacer 50 has a central opening that is configured to mate with the LED 44. Specifically, preferably the central opening 52 is generally circular having a diameter to match the outer diameter of the LED hub 46. In this way, the spacer can be positioned over the LED 44 so that the LED hub 46 projects into the central opening 52 of the spacer. This positions the LED relative to the spacer 50.

Preferably the spacer includes a plurality of recesses and/or windows 54 that are positioned relative to elements on the circuit board 42. The windows 54 are configured to provide clearance for the elements on the circuit board, such as solder pads. In this way, the windows 54 allow the spacer to fit over the elements on the circuit board 42 and sit flush against the circuit board.

As mentioned previously, the lamp assembly 30 includes a housing, and one of the elements of the housing is a cap 60 that fits over the spacer and the LED assembly 40. More specifically, the spacer 50 and the LED assembly nest within the cap, as shown in FIG. 3. Preferably, the cap 60 and the spacer 50 are configured to matingly engage so that the spacer is positioned at a predetermined position relative to the cap. For instance, preferably the cap 60 is a cylindrical element having a flange on one end that projects radially inwardly, overlapping and confronting the top surface of the spacer.

In addition, preferably the shape of the spacer mates with the cap 60. For example, preferably the spacer is a generally circular disc-shaped element and the cap has an internal diameter that mates with the circular edge of the spacer. In this way, the mating engagement between the spacer and the cap positions the spacer relative to the cap, and since the LED is at a fixed position relative to the spacer, the LED is at a fixed radial position relative to the cap. To ensure that the circuit board does not interfere with the alignment between the spacer, LED and cap, it is desirable to configure the circuit board so that it is smaller than the spacer (i.e. the spacer overhangs the terminal edges of the circuit board, as shown in FIG. 3).

Referring to FIG. 3, the cap 60 is connected with a bottom cap in the form of a block 36. The block may be formed in a variety of shapes, however, preferably the block 36 is an elongated generally cylindrical hollow element formed of a thermally conductive material, such as aluminum. In this way, the block operates as a heat sink as well as a portion of the lamp housing. The block is configured to mate with the cap 60. Specifically, the block has an enlarged head that flares outwardly having a upper flange that cooperates with the cap. The cap 60 forms a tight fit with the outer diameter of the enlarged head to position the cap at a predetermined position relative to the block. More specifically, preferably the cap 60 overlies the upper end of the block 36 so that the internal surface of the cap engages the external surface of the block. In addition, preferably the cap 60 is fixedly attached to the block, such as by an interference fit or press fit.

Preferably, the lower end of the block 36 is open and has a recess for receiving the PC board 32. The PC board 32 comprises a circuit board, a resistor 33 and a contact 34 for providing an electrical path from the batteries 15 to the PC board 32. In addition, the wires 48 connected to the LED assembly 40 are also connected to the PC board 32 to provide an electrical path between the PC board and the LED assembly.

The block 36 includes one or more openings to allow the wires 48 to extend into the interior cavity of the block. Specifically, the block 36 includes two openings positioned adjacent the location of the connection between the wires 48 and the LED assembly 40. In this way, the LED can sit flush against the top surface of the block.

Configured as described above, the lamp assembly 30 includes the LED assembly 40 and the spacer 50 sandwiched between the cap 60 and the block 36, with the LED 44 projecting forwardly through the end of the cap.

The lamp assembly 30 is inserted into the housing 20 so that the LED 44 is aligned with the focal axis of the reflector. For instance, the outer surface of the lamp assembly is configured to cooperate with the interior surface of the flashlight head 24. More specifically, the forward end of the lamp assembly, namely the outer diameter of the cap 60 is configured to cooperate with an internal bore of the flashlight head. In this way, the flashlight head positions the lamp assembly 30 at a predetermined position, which in turn positions the LED at a predetermined position.

Figure 6:
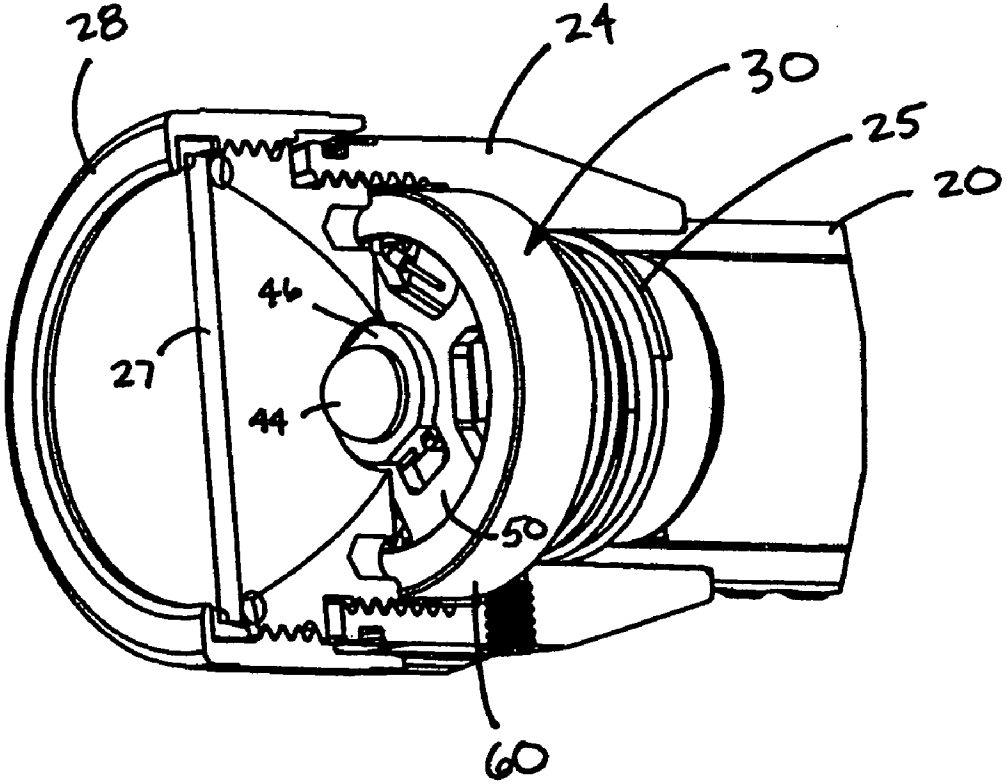
FIG. 6 is an enlarged fragmentary perspective view, partially broken away, of the flashlight shown in FIG. 1.

Referring to FIGS. 1 and 6, a spring 25 is preferably positioned between the lamp assembly 30 and the housing to bias the lamp assembly toward the reflector 26 so that the LED 44 projects inwardly into the reflector. One end of the spring 25 bears against a shoulder formed at the intersection of the barrel and the flashlight head 24. The second end of the spring bears against the lamp assembly 30. In addition, preferably a second spring (not shown) biases the batteries 15 toward the contact 34 on the PC board assembly 32.

The lamp assembly may be positioned within the housing in a variety of ways to align the LED with the reflector 26 other than the manner described above. For instance, the lamp assembly 30 may be configured to mate with the reflector rather than the housing to position the lamp assembly at a predetermined position relative to the reflector so that the LED is aligned with the focal axis of the reflector. More specifically, the reflector may have an alignment element such as a tab that mates with a corresponding recess on the lamp assembly 30 to align the lamp assembly relative to the reflector. By positioning the LED along the focal axis of the reflector, the LED can be positioned at the focal point of the reflector by moving the LED relative to the reflector along the focal axis.

The lamp assembly 30 has been described above as an assembly having separate upper and lower housing elements for receiving the LED assembly 40 and the spacer 50. However, it may be desirable to eliminate the housing elements to reduce the number of components in the flashlight. For instance, the lamp assembly may be reduced to the LED assembly 40 and the spacer 50. An interior surface of the flashlight housing and/or head can then be configured to cooperate with the shape of the spacer. As an example, the interior of the flashlight head may include an annular shoulder for supporting the LED assembly and the spacer. In addition, the interior of the flashlight head may include one or more alignment elements, such as tabs or recesses that cooperate with one or more corresponding alignment elements on the spacer. As an alternative, the flashlight head may have a bore corresponding to the shape and size of the terminal edges of the spacer to align the spacer within the flashlight head similar to the manner in which the spacer cooperates with the cap 60 described above.

In this way, the cooperation between the spacer and the LED 44 operates to position the LED relative to the spacer and the spacer cooperates with the flashlight housing and/or head to position the LED relative to the flashlight housing and/or head. In such a configuration, it is desirable to connect the LED assembly 40 to the spacer, such as by an adhesive or otherwise. By connecting the spacer and LED assembly, the spacer operates to maintain the LED at the proper position.

Figure 8:
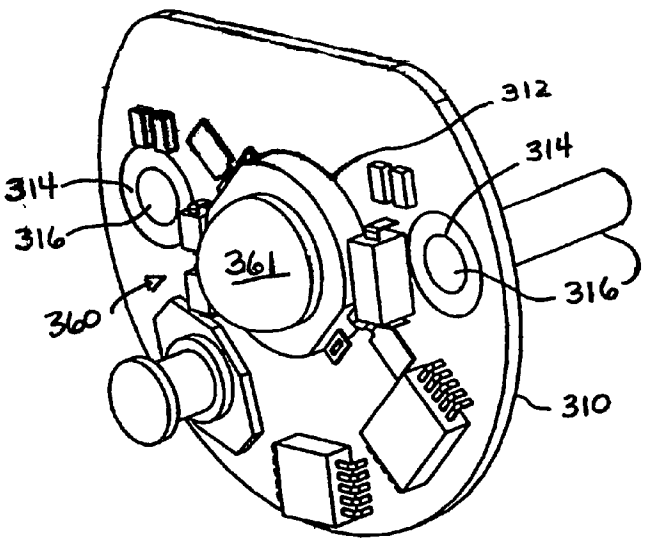
FIG. 8 is an enlarged perspective view of an LED assembly of the flashlight illustrated in FIG. 7.
Figure 7:
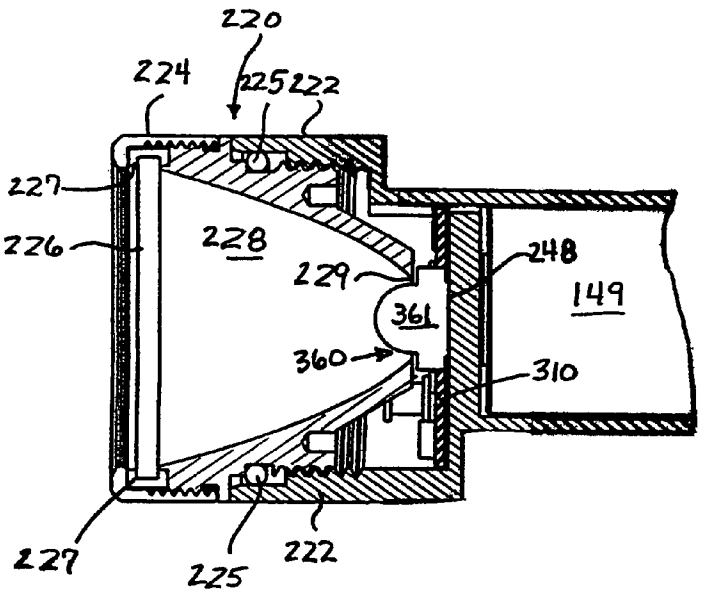
FIG. 7 is a fragmentary sectional view of a second embodiment of a flashlight.
Figure 1:
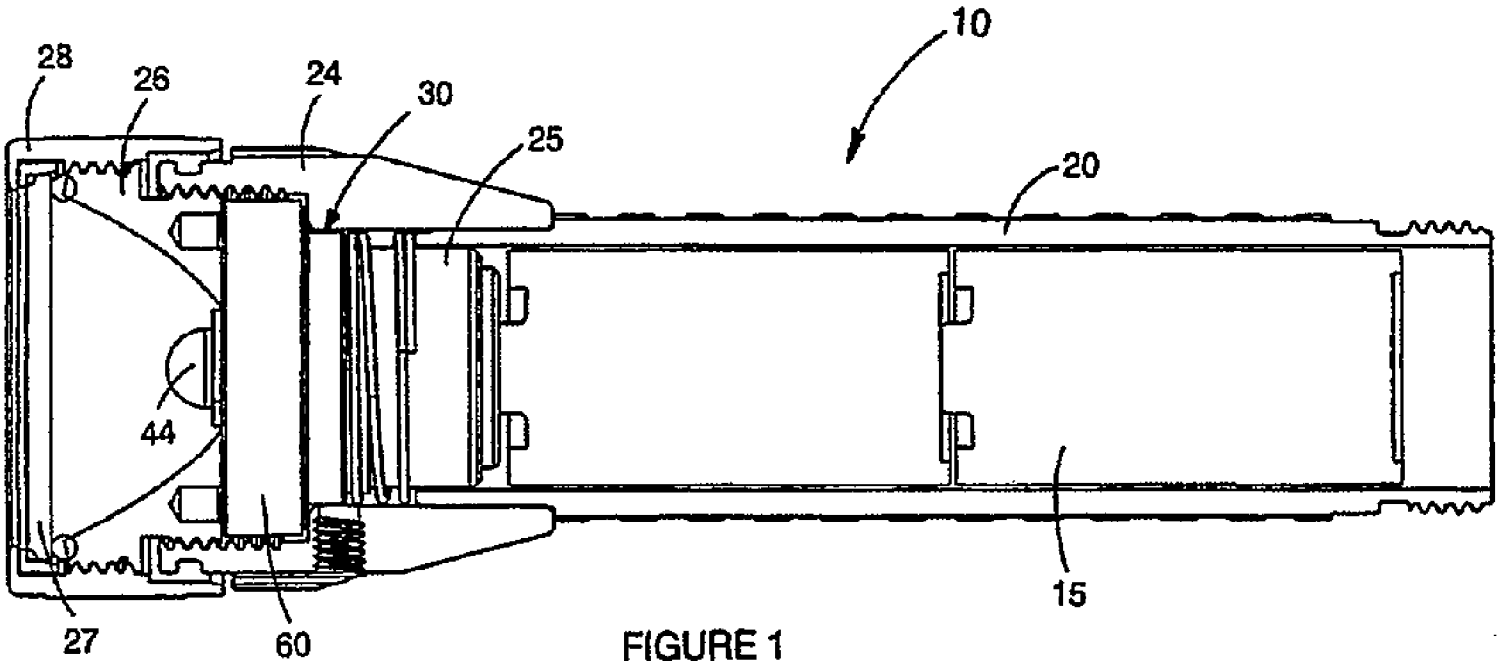
Figure 2:
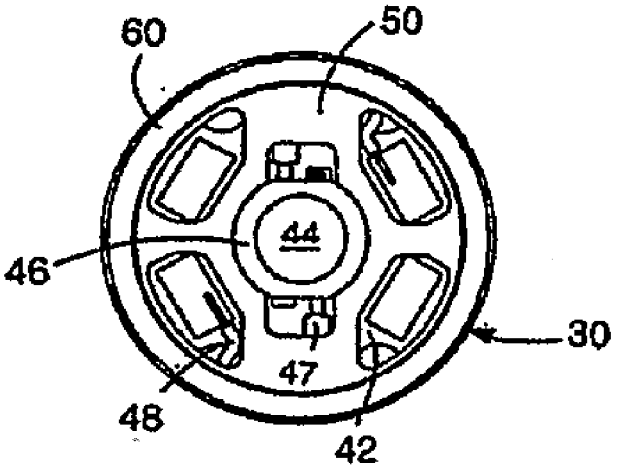
Figure 3:
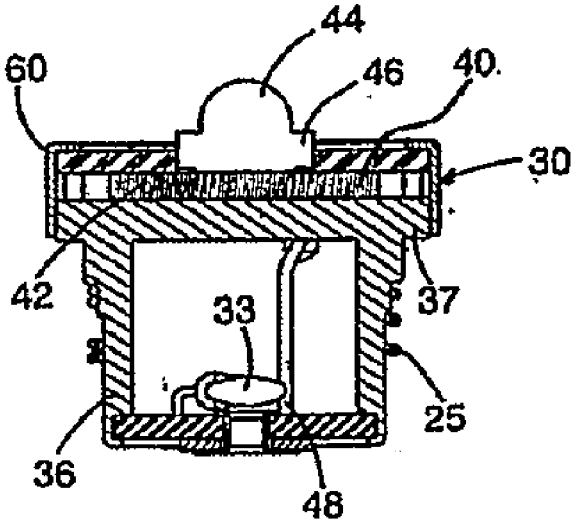
Figure 4:
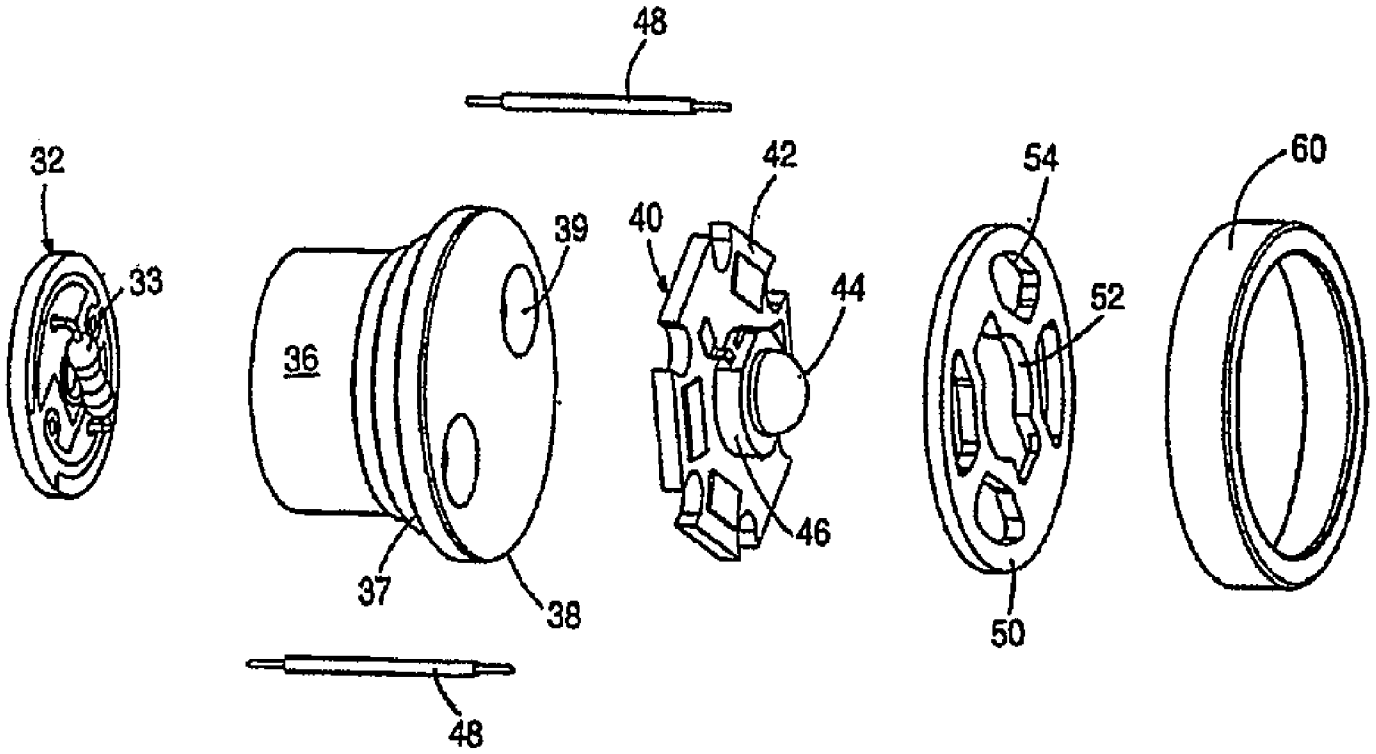
Figure 5:
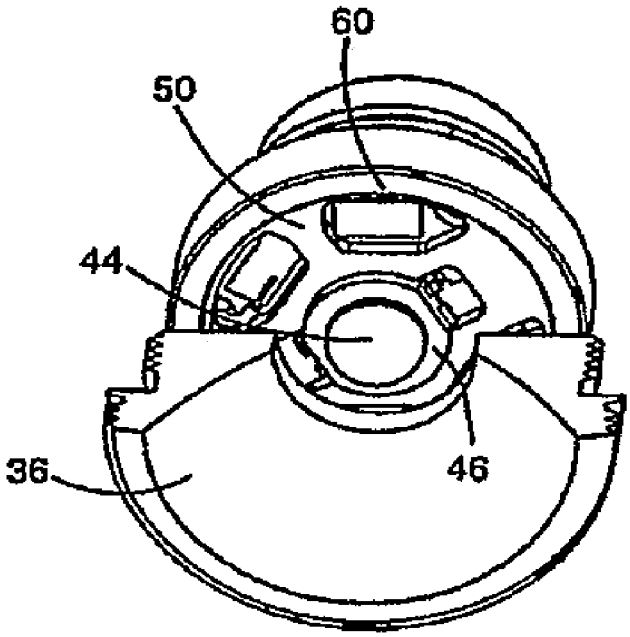
Figure 6:
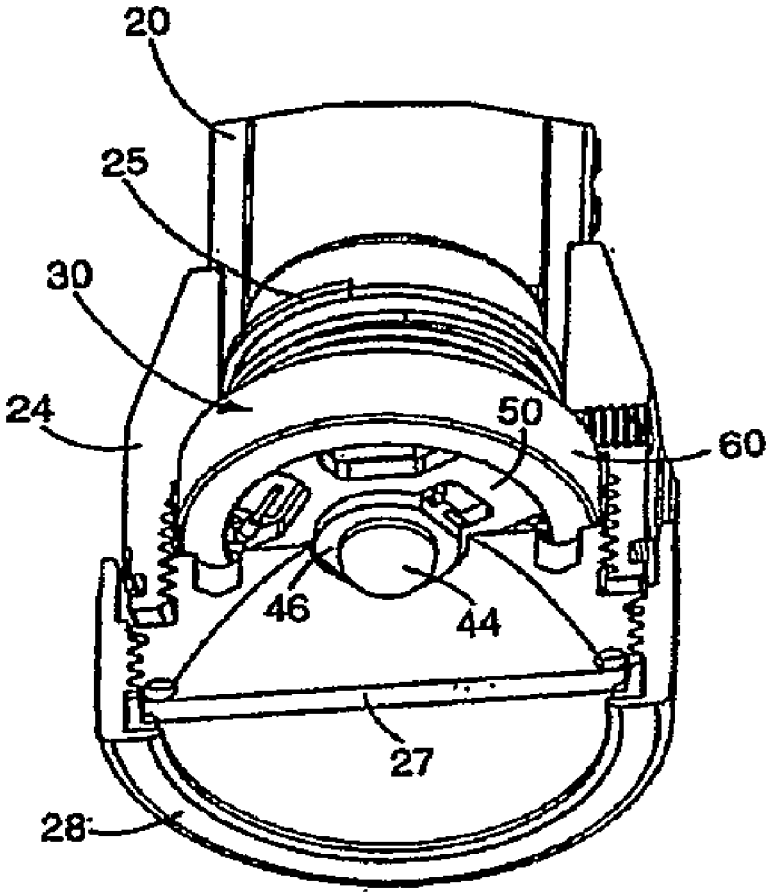
Figure 8:
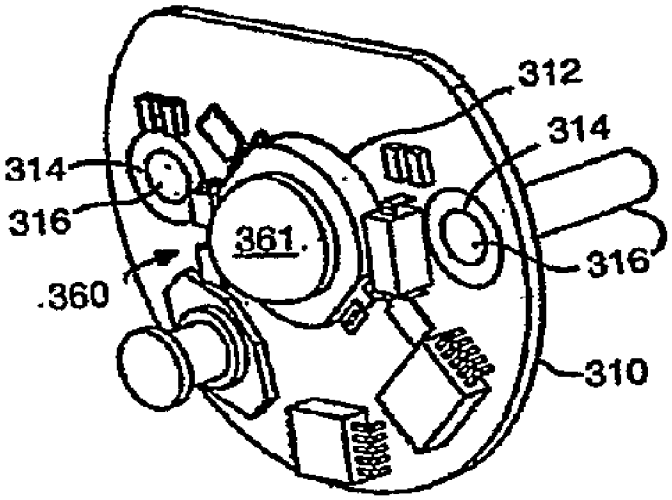
Figure 7:
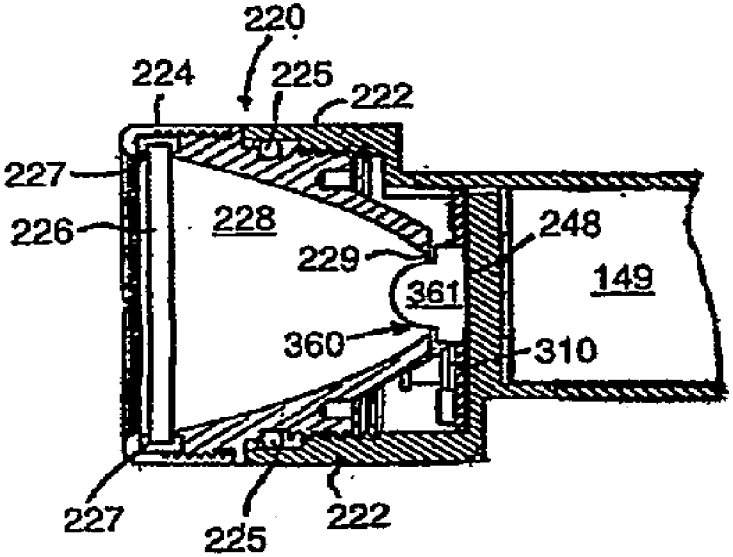

In the embodiment described above, the LED is adhered to a circuit that is bonded to a metal substrate that operates as a heat sink. An alignment element cooperates with the LED to align the LED without regard to the position of the circuit board. Referring now to FIGS. 7 and 8, a second embodiment of a flashlight 210 is illustrated in which the circuit board operates as the aligning element.

Referring now to FIG. 7, the flashlight 210 comprises a housing 240 having a battery compartment, and a lamp head 220 having a light source 360 and a reflector 228 for focusing light from the light source. The flashlight 210 has a forward or head end 212 from which light is emitted when the flashlight 210 is activated and has a rearward or tail end opposite head end 212. The head 220 of the light 210 is at the head end 212 of the flashlight and includes the various elements relating to providing the light beam emitted by the flashlight 210. For example, the head 220 includes a head body 222 and a face cap 224 threaded onto the head body 222. A lens 226 is held in the face cap 224 and a resilient gasket 227 may be provided to absorb shock.

The reflector 228 is threaded into the head body 222 and operates to shape and focus the light produced by light source 360 when the light source is energized to produce light. The reflector 228 has an opening 229 at the rearward end thereof into which the light source 360 extends. The threaded interface between the reflector 228 and the head body 222 may be sealed, e.g., by a seal or gasket, such as O-ring 225, so as to resist entry of moisture and other undesirable substances. The interface between face cap 224 and lens 226 may similarly be sealed by shock absorbing gasket 227.

Referring now to FIG. 8, the details of the light source 360 will be described in greater detail in connection with an exemplary electrical circuit board arrangement 300. The circuit board arrangement 300 comprises a circuit board 310, and is configured to carry various electrical conductors 302 and circuit components provided for the operation of the light source 360. Such circuit components and elements are soldered or otherwise connected to circuit structure 300, as is known to those of skill in the art.

In the present instance, the circuit board 310 is configured to align the LED 361 with the focal axis of the reflector 228. Specifically, the circuit board 310 has a periphery of predetermined shape, e.g., a "D" shape in the example illustrated. The interior of the light body 240 comprises a mounting surface 248 in the form of a circumferential ledge or ridge that is shaped to cooperate with the periphery of the circuit board 310. For instance, in the present embodiment, the mounting surface 248 comprises a shoulder having a circumference that generally forms a D-shape, having one portion that is generally straight and a second portion that is curved. In this way, the mounting surface 248 is operable to cooperate with the periphery of the circuit board to align the circuit board relative to light body 240 and the head 220 mounted thereon.

The light source 360, comprises a light emitting diode having a hub 362. The circuit board 310 comprises a central opening 312 that is sized to cooperate with the peripheral surface of the LED hub 362. Specifically, in the present instance, the LED hub 362 is generally cylindrical and the central opening is a generally circular opening having a diameter that is the same as or slightly larger than the diameter of the LED hub 362. As may be seen in FIG. 7, cooperating surfaces of the LED hub 362 and the circuit board 310 align the LED relative to the circuit board. In turn, the cooperating surfaces of the circuit board and the mounting surface align the LED relative to the reflector. In this way, the circuit board 310 is operable to position the LED 261 so that the LED is aligned with and coaxial with the focal axis of the reflector 228.

The LED 361 and the reflector 228 are generally centrally located in the example illustrated, other locations and other predetermined peripheral shapes may be employed for the mounting surface 248 and the circuit board 310. Where LED 361 is a high-power LED, the light body 240 is preferably of aluminum or other thermally conductive material, and the LED 361 may be coupled to mounting surface 248 with a thermally conductive material, e.g., a thermally conductive grease or a thermally conductive epoxy. Various electrical components relating to operation of the LED 361 may be mounted on the circuit board 310 as illustrated.

The circuit board portion 310 typically has holes 314 therein for receiving electrical power selectively from batteries 149, responsive to operation of a switch. Typically, conductive pins or wires 316 extend forward from batteries 149 through openings in light body 240 to extend into holes 314 of the circuit board 310 of circuit structure 300 into which they are electrically and mechanically secured, such as by soldering. Wires or pins 316 may be generally straight, or may be bent, serpentine or looped so as to absorb some of the mechanical energy generated when flashlight encounters some type of mechanical shock or vibration.

Circuit structure 300 may be made in whole or in part of a flexible printed circuit board material, such as a polyimide. Where the circuit board 310 is utilized for properly positioning the LED 361, the circuit board 310 is preferably relatively less flexible or even relatively rigid, as may be provided by selection of a type of material therefor, e.g., an FR-4 or a glass epoxy material, or by selection of the thickness of the material, or by providing a stiffening member, typically having the predetermined peripheral shape of the circuit board.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. A flashlight, comprising:

a housing;

a reflector disposed within the housing at a predetermined position relative to the housing, wherein the reflector has a focal point along a focal axis;

a lamp assembly, comprising:

a circuit board;

an LED fixedly connected to the circuit board;

a heat sink;

an alignment element configured to mate with the LED to position the LED at a predetermined position relative to the alignment element;

a cap configured to cooperate with the heat sink to position the alignment element and the circuit board between the cap and the heat sink; and a lamp housing configured to mate with the alignment element to position the alignment element at a predetermined position relative to the lamp housing;

wherein the lamp assembly is configured to mate with the housing to position the lamp assembly at a predetermined position relative to the housing, thereby positioning the LED at a predetermined position relative to the focal axis of the reflector.

2. The flashlight of claim 1 wherein the circuit board has an outer diameter that is greater than the outer diameter of the LED.

3. The flashlight of claim 1 wherein the alignment element comprises an opening that is configured to mate with and receive the LED in a predetermined orientation.

4. The flashlight of claim 1 wherein the alignment element comprises a spacer having a peripheral surface that mates with an internal surface of the cap.

5. The flashlight of claim 1 wherein the LED comprises a hub and the alignment element is configured to mate with the hub.

6. A method for producing a flashlight, comprising the step of:

assembling a lamp assembly comprising a housing, an LED having a hub, and a locating element, comprising the steps of;

positioning the locating element over the hub of the LED to position the LED relative to the locating element;

positioning the locating element at a predetermined position relative to the housing;

connecting the lamp assembly to a flashlight body to position the lamp assembly at a predetermined position relative to the body;

connecting a reflector to the flashlight body to position the reflector at a predetermined position relative to the lamp assembly, thereby positioning the reflector at a predetermined position relative to the LED.

7. The method of claim 6 wherein the step of assembling the lamp assembly comprises the step of attaching the LED to a circuit board.

8. The method of claim 7 wherein the step of assembling the lamp assembly comprises connecting the circuit board with a heat sink.

9. The method of claim 6 wherein the locating element comprises an opening configured to mate with the LED hub and the step of assembling the lamp assembly comprises the step of aligning the opening with the LED hub and inserting the LED through into the opening.

10. The method of claim 7 wherein the LED hub comprises a plurality of electrical contacts for the LED, and the step of assembling the lamp assembly comprises the step of electrically connecting one or more of the contacts with an electrical path on the circuit board.

11. The method of claim 6 wherein the housing comprises a top element and a bottom element and the locating element is configured to cooperate with the top element to position the locating element at a predetermined position relative to the top element.

12. The method of claim 11 wherein the step of assembling the lamp assembly comprises the step of engaging the LED hub with the locating element and engaging the locating element with the top element before connecting the top element with the bottom element to enclose the lamp assembly.

13. A flashlight, comprising:

a housing;

a reflector disposed within the housing at a predetermined position relative to the housing, wherein the reflector has a focal point along a focal axis a lamp assembly, comprising:

an LED; and a circuit board having an outer periphery, wherein the circuit board is configured to mate with the LED to position the LED at a predetermined position relative to the circuit board;

wherein the housing comprises an internal mounting surface configured to cooperate with the periphery of the circuit board to align the LED with the focal axis of the reflector, thereby positioning the LED at a predetermined position relative to the focal axis of the reflector.

14. The flashlight of claim 13 wherein the LED comprises a hub and the circuit board comprises an LED alignment element cooperable with the hub to position the LED at a predetermined position relative to the circuit board.

15. The flashlight of claim 14 wherein the LED hub comprises a outer periphery and the LED alignment element comprises an opening in the circuit board having an internal shape configured to mate with the outer periphery of the LED hub.

16. The flashlight of claim 14 wherein the internal mounting surface comprises an internal shoulder in the interior of the housing, wherein the internal shoulder is configured to mate with the outer periphery of the circuit board.

17. A flashlight, comprising:

a housing;

a reflector having a reflective surface, wherein the reflective surface is disposed about a focal axis;

an light assembly, comprising:

an LED comprising a hub; and a locating element having a first surface configured to cooperate with a surface of the LED hub to position the LED at a predetermined position relative to the locating element;

wherein the locating element is configured to be positioned over the hub of the LED so that the locating element is positioned between a rearward end of the hub and the reflector;

wherein the light assembly has a surface configured to cooperate with a second alignment surface to position the light assembly at a predetermined positioned relative to the focal axis of the reflector.

18. The flashlight of claim 17 wherein the light assembly comprises a circuit board and the LED is fixedly connected to the circuit board.

19. The flashlight of claim 18 wherein the circuit board has an outer diameter that is greater than the outer diameter of the hub of the LED.

20. The flashlight of claim 19 comprising a cap having an internal diameter that is greater than the outer diameter of the circuit board and the outer diameter of the locating element.

21. The flashlight of claim 20 wherein the locating element and the circuit board are nested within the cap.

22. The flashlight of claim 17 wherein the locating element comprises an aperture configured to cooperate with the surface of the LED hub, wherein the LED hub projects through the aperture.

23. The flashlight of claim 17 where the light assembly comprises an electrical path for energizing the LED, wherein the locating element is insulated from the electrical path.

24. A flashlight, comprising:

a housing;

a reflector disposed within the housing at a predetermined position relative to the housing, wherein the reflector has a focal point along a focal axis;

a lamp assembly, comprising:

an LED having a base a circuit board connected with the base of the LED, wherein the LED overlies a portion of the circuit board, wherein such portion of the circuit board is larger than the base of the LED;

an alignment element configured to mate with the LED to position the LED at a predetermined position relative to the alignment element;

wherein the lamp assembly is configured to mate with the housing to position the lamp assembly at a predetermined position relative to the housing, thereby positioning the LED at a predetermined position relative to the focal axis of the reflector.

25. The flashlight of claim 24 wherein the alignment element is disposed between the circuit board and the reflector.

26. The flashlight of claim 24 wherein the alignment element comprises a first alignment surface configured to cooperate with a second alignment surface to align the lamp assembly relative to the reflector to align the LED with the focal axis.

27. The flashlight of claim 24 wherein the lamp assembly comprises a base and a cap cooperable with the base, wherein the alignment element, LED and circuit board are retained between the cap and the base.

28. The flashlight of claim 24 wherein the alignment element comprises an aperture and the LED projects into the aperture.

29. The flashlight of claim 24 wherein the lamp assembly comprises an electrical path operable to connect the LED with a power source, and the alignment element is electrically insulated from the electrical path.

30. A flashlight, comprising:

a housing;

a reflector disposed within the housing at a predetermined position relative to the housing, wherein the reflector has a focal point along a focal axis;

a lamp assembly, comprising:

an LED having a base;

an electrical path operable to connect the LED with a power source;

an alignment element configured to mate with the LED to position the LED at a predetermined position relative to the alignment element, wherein the alignment element is electrically insulated from the electrical path;

a lamp housing configured to mate with the alignment element to position the alignment element at a predetermined position relative to the lamp housing;

wherein the lamp assembly is configured to mate with the housing to position the lamp assembly at a predetermined position relative to the housing, thereby positioning the LED at a predetermined position relative to the focal axis of the reflector.

31. The flashlight of claim 30 wherein the alignment element is disposed between the circuit board and the reflector.

32. The flashlight of claim 30 wherein the alignment element comprises a first alignment surface configured to cooperate with a second alignment surface to align the lamp assembly relative to the reflector to align the LED with the focal axis.

33. The flashlight of claim 30 wherein the lamp assembly comprises a base and a cap cooperable with the base, wherein the alignment element, LED and circuit board are retained between the cap and the base.

34. The flashlight of claim 30 wherein the alignment element comprises an aperture and the LED projects into the aperture.

35. The flashlight of claim 30 wherein the LED overlies a portion of the circuit board and wherein such portion of the circuit board is larger than the base of the LED.

* * * * *

UNITED STATES PATENT AND TRADEMARK OFFICE

CERTIFICATE OF CORRECTION

PATENT NO. : 7,093,954 B2
APPLICATION NO. : 11/015731
DATED : August 22, 2006
INVENTOR(S) : Sharrah et al.

It is certified that error appears in the above-identified patent and that said Letters Patent is hereby corrected as shown below:

Title page should be deleted and substitute therefor the attached title page

Replace drawings with the attached formal drawings, consisting of Figs 1-6 as shown on the attached pages.

Signed and Sealed this

Twenty-sixth Day of December, 2006

JON W. DUDAS
*Director of the United States Patent and Trademark Office*

(12) United States Patent
Sharrah et al.

(10) Patent No.: US 7,093,954 B2
(45) Date of Patent: Aug. 22, 2006

(54) FLASHLIGHT HAVING LED ASSEMBLY AND METHOD FOR PRODUCING SAME

(75) Inventors: Raymond L. Sharrah, Collegeville, PA (US); John DiNenna, Bridgeport, PA (US)

(73) Assignee: Streamlight, Inc., Eagleville, PA (US)

( * ) Notice: Subject to any disclaimer, the term of this patent is extended or adjusted under 35 U.S.C. 154(b) by 0 days.

(21) Appl. No.: 11/015,731

(22) Filed: Dec. 17, 2004

(65) Prior Publication Data

US 2005/0135090 A1 Jun. 23, 2005

Related U.S. Application Data

(60) Provisional application No. 60/627,860, filed on Nov. 15, 2004, provisional application No. 60/531,174, filed on Dec. 19, 2003.

(51) Int. Cl.
*F21L 4/00* (2006.01)
*F21V 29/00* (2006.01)

(52) U.S. Cl. ..... 362/202; 362/294; 362/800

(58) Field of Classification Search ..... 362/183, 362/184, 202, 204, 205, 20, 208, 197, 294, 362/800, 157

See application file for complete search history.

(56) References Cited

U.S. PATENT DOCUMENTS

| | | | | |
|---|---|---|---|---|
| 6,502,952 | B1 * | 1/2003 | Hartley | 362/184 |
| 6,595,656 | B1 * | 7/2003 | Yoda | 362/187 |
| 6,827,468 | B1 * | 12/2004 | Gaill | 362/294 |
| 2003/0147237 | A1 * | 8/2003 | Halasz | 362/187 |
| 2004/0240201 | A1 * | 12/2004 | Raussock | 362/171 |

* cited by examiner

*Primary Examiner*—Alan Cariuso
*Assistant Examiner*—James W Cranson, Jr.
(74) *Attorney, Agent, or Firm*—Stephen H. Eland; Dann, Dorfman, Herrell and Skillman

(57) ABSTRACT

A flashlight is provided having a housing, a reflector and a light source, such as an LED. Preferably, an alignment structure is provided for aligning the LED with the focal axis of the reflector. For instance, the LED may be fixed to a circuit board, and the flashlight may include an alignment element configured to mate with the LED to position the LED at a pre-determined position. Alternatively, the LED may be electrically connected with a circuit board, and the circuit board my include an opening for receiving the LED to position the LED at a pre-determined position.

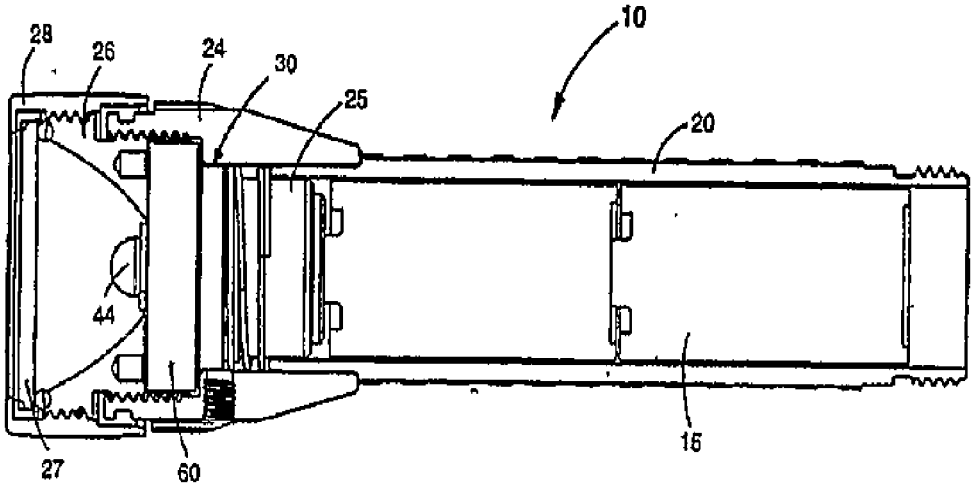

35 Claims, 6 Drawing Sheets